United States Patent [19]

Matsumoto

[11] 4,184,440

[45] Jan. 22, 1980

[54] DEVICE FOR SELECTING LAMINATE CAM FOR SEWING MACHINES

[75] Inventor: Setsuo Matsumoto, Utsunomiya, Japan

[73] Assignee: The Singer Company, New York, N.Y.

[21] Appl. No.: 899,443

[22] Filed: Apr. 24, 1978

[30] Foreign Application Priority Data

Apr. 18, 1977 [JP] Japan ..... 52-5543

[51] Int. Cl.[2] ..... D05B 3/02; D05B 3/04

[52] U.S. Cl. ..... 112/158 A

[58] Field of Search ..... 112/158 A, 158 D, 158 R

[56] References Cited

U.S. PATENT DOCUMENTS

| | | | |
|---|---|---|---|
| 3,055,325 | 9/1962 | Adler | 112/158 A |
| 3,067,702 | 12/1962 | Shimada | 112/158 A |
| 3,091,200 | 5/1963 | Fukunaga | 112/158 A |
| 3,834,332 | 9/1974 | Gude | 112/158 A |
| 4,063,525 | 12/1977 | Sasaki | 112/158 A |

*Primary Examiner*—Werner H. Schroeder
*Assistant Examiner*—Andrew M. Falik
*Attorney, Agent, or Firm*—Robert E. Smith; Edward L. Bell; William V. Ebs

[57] ABSTRACT

A cam selector mechanism for sewing machines in which the followers for a stack of zig zag and work feed controlling pattern cams are positioned selectively by separate spiral linkage controlling grooves formed in a single control dial which can be manipulated from the exterior of the sewing machine in order that composite patterns of ornamental stitches can be obtained. The selector dial also influences a pattern indicating device simultaneously with cam selection.

3 Claims, 7 Drawing Figures

DEVICE FOR SELECTING LAMINATE CAM FOR SEWING MACHINES

BACKGROUND OF THE INVENTION

This invention is related to a device for selecting a laminate cam for sewing machines equipped with laminate zig zag pattern cams and laminate feed cams with which are engaged a zig zag cam follower and a feed cam follower, respectively, so that a laminate zig zag pattern cam and a laminate feed cam can be selected to effect the stitching of composite patterns depending upon the selections.

A linking system, gear system or the like are usually employed for the stitch pattern-indicating mechanism, zig zag pattern cam-selection mechanism and the feed cam-selection mechanism used for the sewing machines. With such known systems, however, even if a control dial for selection provided at the front surface of the sewing machine is turned in a given direction, the follower lever moves only in one direction. Therefore, to obtain a certain desired number of stitch patterns including composite patterns, it is necessary to provide zig zag pattern cams of a number equal to the number of stitch patterns as well as feed cams of a number needed for obtaining composite patterns.

SUMMARY OF THE INVENTION

The object of this invention is to provide a device for selecting a laminate cam for use in sewing machines, which enables composite patterns to be materialized by way of a simple mechanism and easy operation without requiring such complicated mechanisms.

To achieve this object, the device of this invention is provided with a disk cam, the front surface of which having a spiral groove to select a stitch pattern by means of a pointer needle attached to a lever having a pin which engages said groove, and the back surface of which disk cam having two cam-selection grooves, i.e., a zig zag pattern cam-selection groove and a feed cam-selection groove, the former groove being interlocked to a cam follower and the latter groove being interlocked to a feed cam follower. In addition, according to this invention, these cam-selection grooves are formed in particular shapes, so that a combination of two or more pattern cams is allowed for a single feed cam. By this setup of this invention, an increased number of composite patterns can be obtained as compared to the prior arts using the same number of cams.

DESCRIPTION OF THE DRAWINGS

THe drawings show an embodiment of this invention, in which.

DETAILED DESCRIPTION OF THE INVENTION

A preferred embodiment of the invention with reference to the accompanying drawings will now be described.

Figure 2:
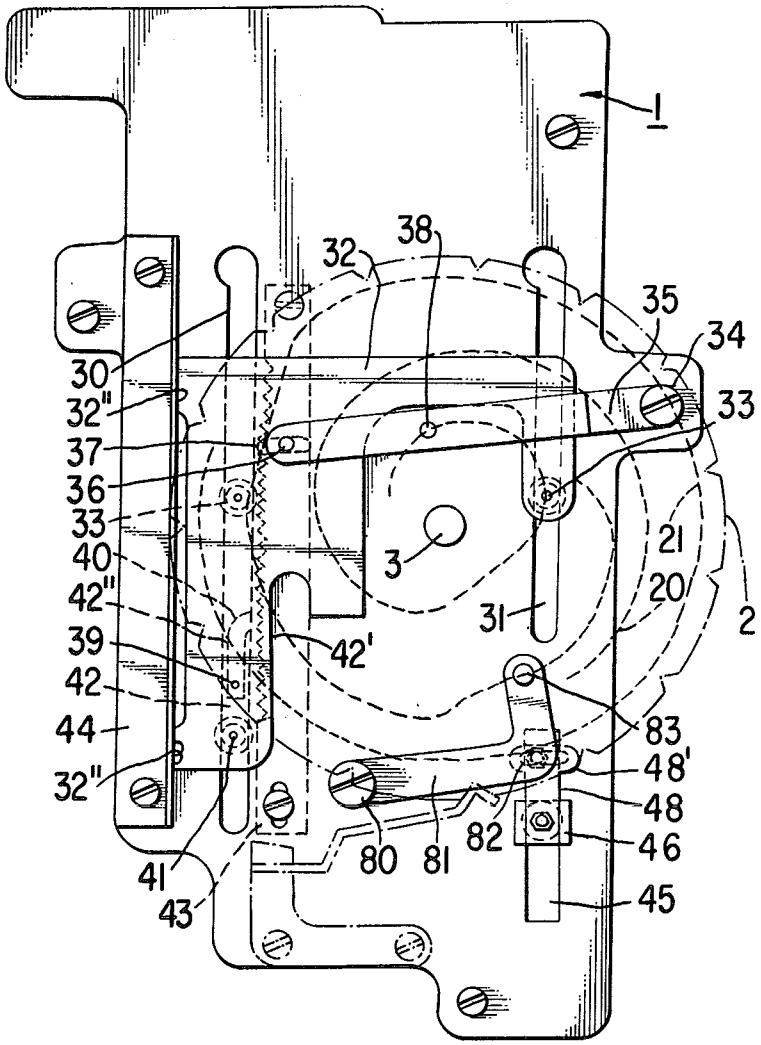
FIG. 2 is a plan view showing a mechanism for selecting zig zag pattern cams and a mechanism for selecting feed cams.
Figure 1:
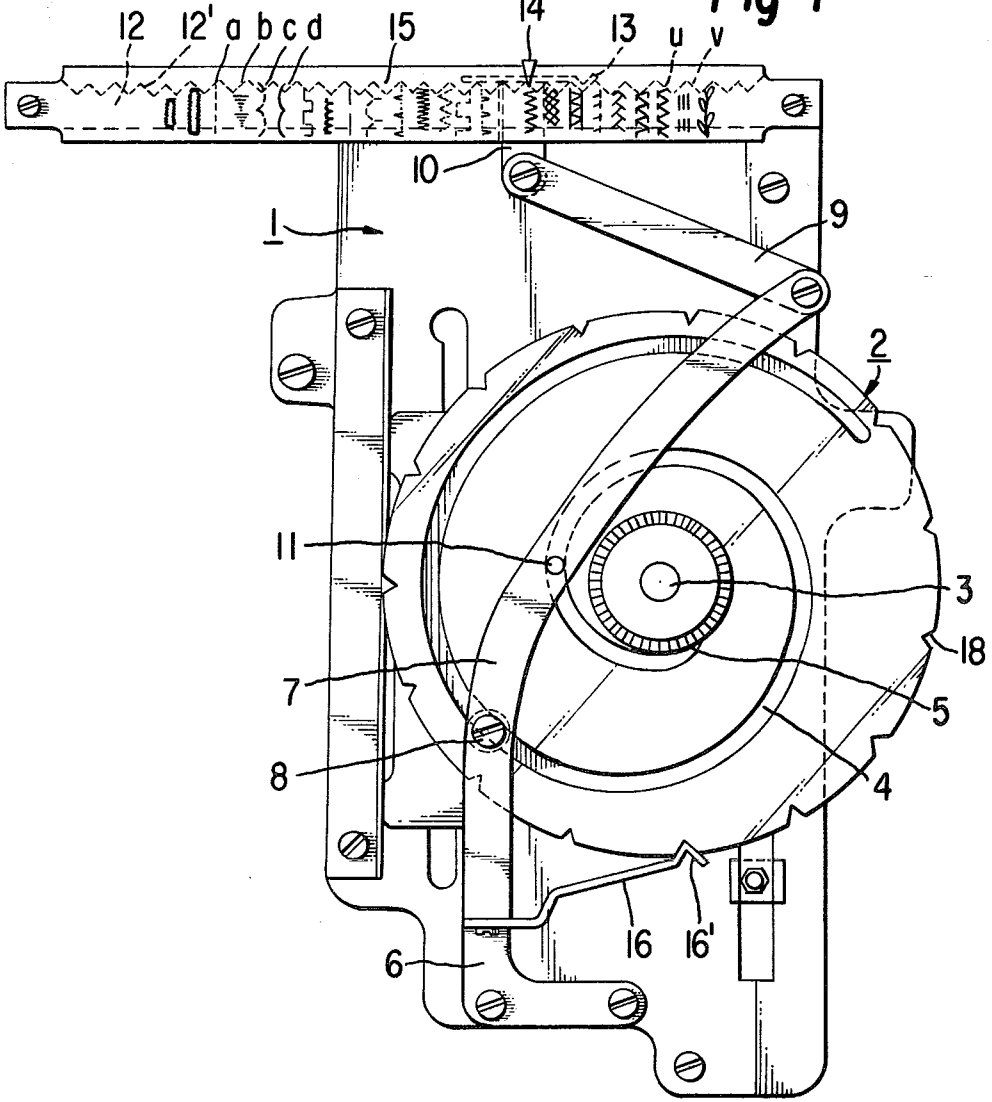
FIG. 1 is a front view showing a mechanism for selecting the stitch patterns.
Figure 3:
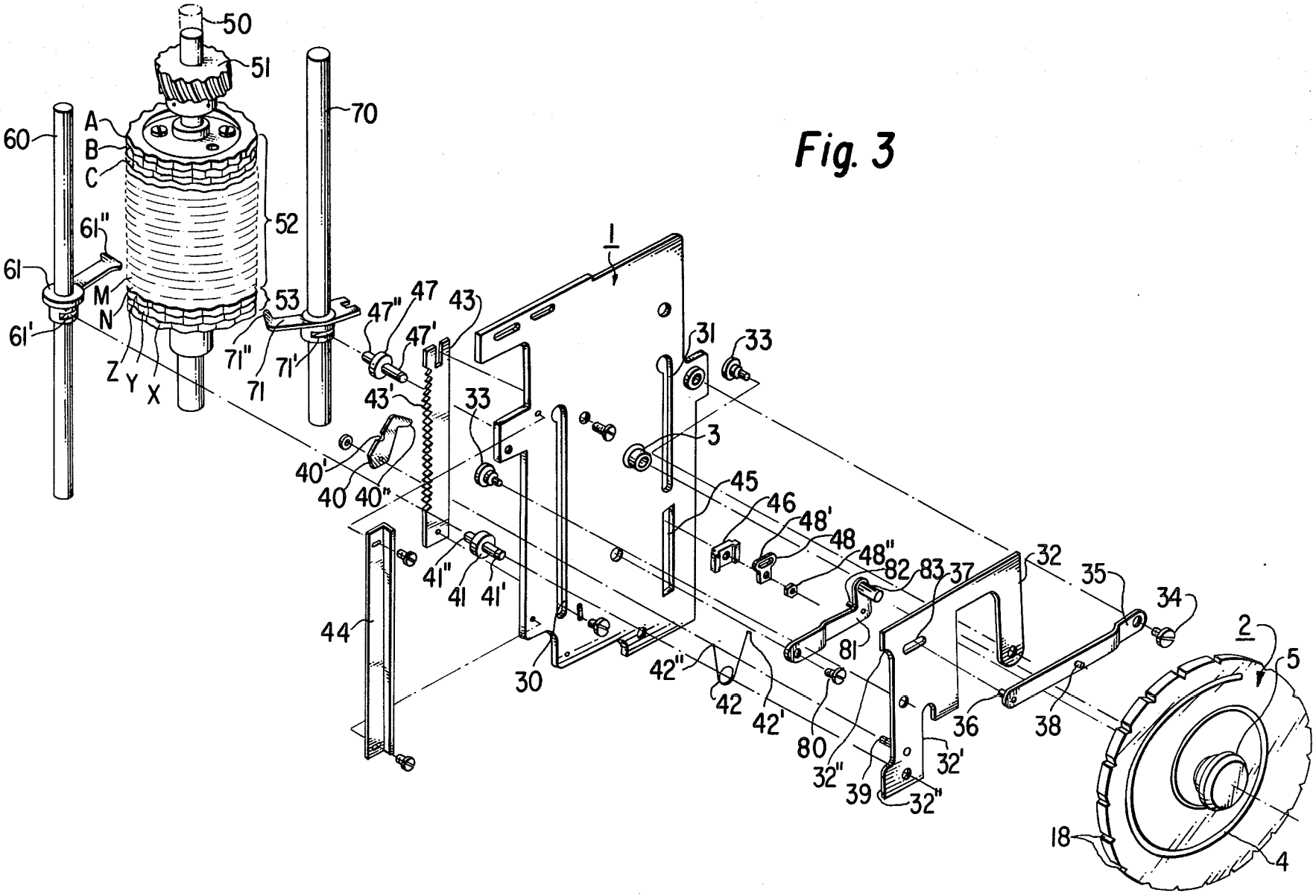
FIG. 3 is a perspective view showing in a disassembled manner the relation among the members shown in FIG. 2, laminate cams and follower levers.
Figure 4:
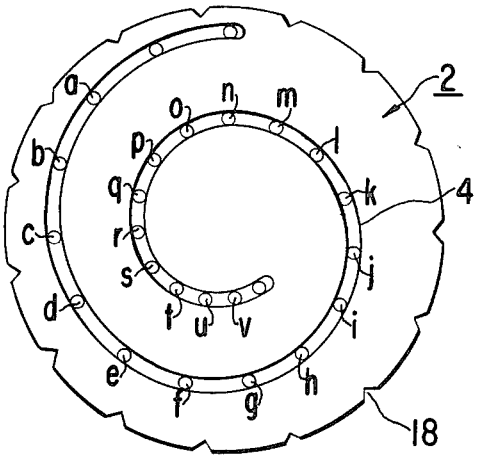
FIG. 4 is a plan view showing a disk cam and a stitch pattern-selection groove formed on the front surface thereof.
Figure 5:
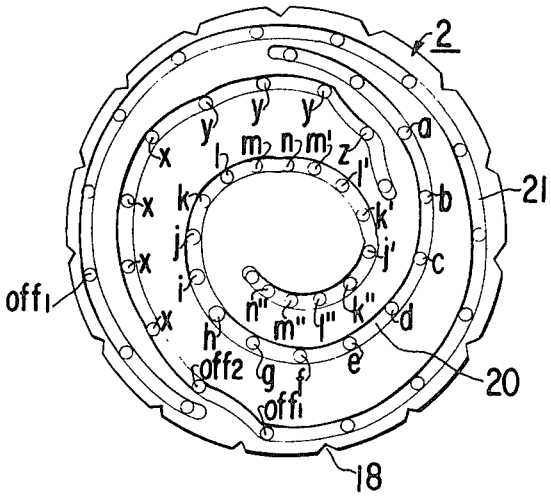
FIG. 5 is a plan view showing the disk cam, and a zig zag pattern cam-selection groove and a feed cam-selection groove formed on the back surface thereof.

As shown in FIGS. 1 to 3, a disk cam 2 is rotatably mounted on a shaft 3 which is secured at the central part on the front surface of a rectangular mounting plate 1 which is installed in a sewing machine housing. On the front surface of the disk cam 2 is formed a spiral pattern-selection groove 4 as shown in detail in FIG. 4. On the disk cam 2 is integrally formed a control dial 5 so that it can be operated on the front surface of the sewing machine. At a lower part on the front surface of the mounting plate 1 is also secured an L-shaped bracket 6. To the upper part of the bracket 6 is pivoted an end of a circular pointer needle operation lever 7 by means of a shouldered screw 8, and the other end of said level 7 is rotatably linked to a vertically disposed pointer needle member 10 via a link 9. On the upper surface at the central part of the pointer needle operation lever 7 is secured a pin 11 which engages the spiral pattern selection groove 4 formed on the front surface of the diskcam 2. Further, at the upper part on the front surface of the mounting plate 1 is mounted a planar slide plate 12 having rack 12' at its upper part in parallel with said mounting plate 1 and maintaining a clearance from the front surface of the mounting plate 1. A pointer needle member 10 is allowed to slide along the clearance between the slide plate 12 and the mounting plate 1. The upper edge of the pointer needle member 10 is folded to overlap the upper edge of the slide plate 12, and a spring 13 attached to one end of the pointer needle member 10 is engaged with the rack 12' to eliminate the looseness that may develop when a pointer needle 14 formed integrally together with the pointer needle member 10 is shifted. On the front surface of the slide plate 12 is installed a pattern plate 15 describing stitch patterns a, b, c, etc., which will appear on the front surface of the sewing machine. The pointer needle 14 moves along the upper edge of the pattern plate to indicate any one of the stitch patterns a, b, c, etc. To the bracket 6 is attached an end of a disk cam spring 16, and the other end 16' of said spring 16 is formed in a V-shape to engage grooves 18 of the same number as zig zag pattern cams 52 which will be mentioned later, said grooves 18 being formed on the outer periphery of the disk cam 2, thereby to determine the positions of the stitch patterns a, b, c, etc. selected by the pointer needle 14, as well as to simultaneously determine the positions of cam followers 61, 71 that will be mentioned later. Further, on the back surface of the disk cam 2 rotatably mounted on t[illegible] mounting plate 1 are formed two spiral grooves, i.e., one being a zig zag pattern cam-selection groove 20 and the other being a feed cam-selection groove 21 as shown in FIG. 5. In the mounting plate 1 are further vertically formed two elongated groove 30, 31 that are in parallel with a cam shaft 50 which will be mentioned later. To the elongated grooves 30, 31 is fitted a rectangular operation plate 32 in a manner to slide in said elongated grooves 30, 31 by means of flanged pins 33, 33 that are fastened from the back surface of the mounting plate 1. Further, at the upper part on the front surface of the mounting plate 1 is rotatably attached an operation plate lever 35 by means of a shouldered screw 34, and a pin 36 attached to the other end of the operation plate lever 35 is slidably engaged with an elongated groove 37 formed on the operation plate 32 in the direction at right angles to said elongated grooves 30, 31. A pin 38 secured at a middle part on the front surface of the lever 35 engages the zig zag pattern cam-selection groove 20 formed on the back surface of the disk cam 2. Further, onto the back surface of the operation plate 32 is secured a pin 39 which penetrates through the elongated groove 30 formed in the mounting plate 1; onto said pin 39 is rotatably mounted a positioning latch 40 on the back surface of the mounting plate 1. A shaft part 41' of a flanged positioning pin 41 penetrating through the elongated groove 30 from the back surface of the mounting plate 1 is secured onto the back surface of the operation plate 32, and to said shaft part 41' is fitted a base part of a wire spring 42. One end 42' of the wire spring 42 is hooked to an arm 40' of the latch 40, and the other end 42'' is hooked to a part 32' of the operation plate 32, so that an end 40'' of the positioning latch 40 will engage a rack 43' formed on one side of a positioning plate 43 which is adjustably mounted on the back surface of the mounting plate 1 in parallel with the elongated groove 30.

To the cam shaft 50 supported on the machine housing, on the other hand, are fitted a cam shaft gear 51, several laminate zig zag pattern cams 52 and several laminate feed cams 53, so that the rotation of an upper spindle (not shown) will be transmitted to the laminate zig zag pattern cams 52 and the laminate feed cams 53 via said cam shaft gear 51, in the same manner as done conventionally. A cam follower shaft 60 is mounted on the machine housing in parallel with the cam shaft 50, and to said shaft 60 is slidably mounted a cam follower 61. With a recess 61' formed at the base part of said cam follower 61 is engaged the end 41'' of the positioning pin 41. The cam follower 61 has an end 61'' which is always forced to come into contact with one of the laminate pattern cams 52 due to the resilient force of a spring (not shown). To the front surface of the mounting plate 1 is secured an L-shaped operation plate guide 44. The ends 32'', 32'' formed on the upper and lower parts on one side of the operation plate 32 are guided along said operation plate guide 44; the operation plate 32, therefore, is allowed smoothly to move along the elongated grooves 30, 31 by way of shouldered pins 33, 33.

Another elongated groove 45 is further formed in the mounting plate 1 in parallel with the elongated grooves 30, 31, and onto said elongated groove 45 is slidably mounted a slide block 46 by way of the shaft 47' of the flanged feed positioning pin 47 that is penetrated from the back surface of the mounting plate 1. Further, a slide block adjustor plate 48 having a laterally elongated hole 48' is secured at its base part to the slide block 46 by fastening a nut 48'' to the shaft 47' of the positioning pin 47. A feed cam follower shaft 70 is mounted on the machine frame in parallel with the cam shaft 50, and on said follower cam shaft 70 is slidably mounted a feed cam follower 71. With a recess 71' formed on the base part of said feed cam follower 71 is engaged an end 47'' of the positioning pin 47. The end 71'' of said feed cam follower 71 is always forced to come into contact with one of the laminate feed cams 53 due to the force of a spring (not shown), or is located at a position (below the feed cams in the drawing) at which it does not engage the feed cams 53. Moreover, on the front surface of the mounting plate 1 is rotatably mounted an L-shaped slide block lever 81 which is held at its one end by a stepper screw 80. A pin 82 secured on the back surface of the lever 81 engages a laterally elongated hole 48' of the slide block adjustor plate 48, and a pin 83 secured on the front surface at the other end engages the feed cam-selection groove 21 formed on the back surface of the disk cam 2. As shown in the expansion plans of selection grooves 20, 21 of FIG. 6, according to the embodiment of this invention, the spiral of the zig zag pattern cam-selection groove 20 defines a distance to the center which gradually reduces as it approaches toward the center, and which increases from a given point, and which reduces again gradually as the groove advances toward the center. For example, the distance is equal at positions m, m' and m'' on the groove 20. The spiral of the feed cam-selection groove 21, on the other hand maintains an equal distance to the center over some part of the groove, and gradually reduces the distance to the center after a given point is passed on the groove 21.

The device according to this invention is constructed as mentioned above. The operation of the device is explained below.

First, when the patterns are to be selected, the cam follower 61 and the feed cam follower 71 which are forced to come into contact with the laminate zig zag pattern cams 52 and the laminate feed cams 53 by the action of springs (not shown), are retracted via the cam follower shaft 60 and the feed cam follower shaft 70 so that they are released from contact with the cams. The mechanism for the above follower retraction operation, however, is not included in the scope of this invention, and is not illustrated here.

To obtain desired stitch patterns, a control dial 5 attached to a disk cam 2 is turned so that the pointer needle operation lever 7 engaged via a pin 11 with the spiral pattern-selection groove 4 formed on the front surface of the disk cam 2 is moved via said pin 11 with a shouldered screw 8 as a fulcrum, and the pointer needle member 10 is shifted on the slide plate 12 via a link 9, thereby to set the pointer needle 14 at one of the stitch patterns a, b, c, etc. described on the pattern plate 15. As mentioned earlier, the grooves 18 have been formed on the outer periphery of the disk cam 2, and to one of said grooves 18 is engaged the end 16' of the disk cam spring 16. The control dial 5 can be easily turned by hand against the force of the spring 16. and said engagement helps the pointer needle 14 to determine a position of the stitch patterns a, b, c, etc.

The operation of the mchanism for selecting the zig zag pattern cams will now be described.

By turning the control dial 5, the control plate lever 35 having pin 38 engaged with the zig zag pattern cam-selection groove 20 formed on the back surface of the disk cam 2, is turned with the shouldered screw 34 as a fulcrum in cooperation with the pin 11 of the pointer needle peration lever 7. Further, the pin 36 provided on the other end of the lever 35 has been engaged with the elongated groove 37 of the operation plate 32, and the operation plate 32 has been so mounted on the mounting plate 1 as to slide in the elongated grooves 30, 31 by means of flanged pins 33, 33. Therefore, if the control dial 5 is turned, the operation plate 32 moves in the up and down directions due to the action of the wire spring 42 being guided by the operation plate guide 44. To the operation plate 32 has also been attached the positioning pin 41 penetrating through the elongated groove 30 of the mounting plate 1, and the end 41'' thereof has been engaged with the recess 61' of the cam follower 61. Therefore, the operation plate 32 so works that the cam follower 61 moves up and down on the cam follower shaft 60, in order that the end 61'' of the cam follower 61 will select one of the laminate pattern cams 52. The positioning latch 40 engaged with the pin 39 of the operation plate 32 has its end 40'' engaged due to the wire spring 42 with the rack 43' of the positioning plate 43 which is adjustably mounted on the back surface of the mounting plate 1, thereby to reliably determine the stop position of the cam follower 61.

Figure 6:
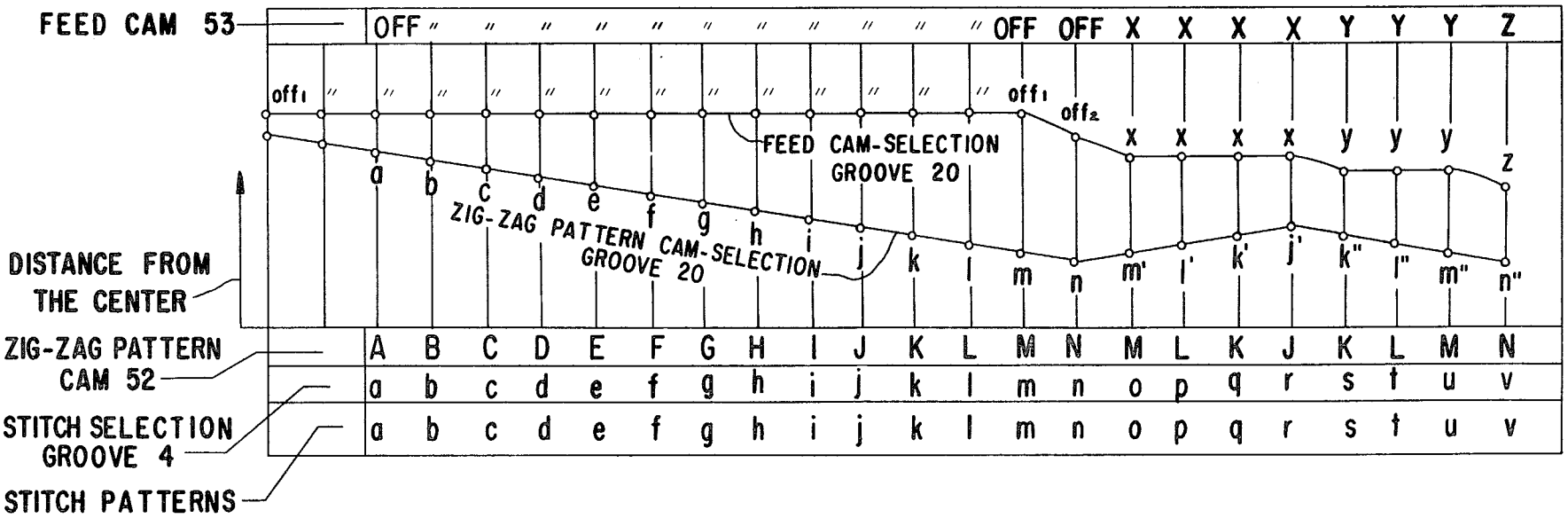
FIG. 6 is a diagram showing in the form of an expansion plan the distances of the zig zag pattern cam-selection groove and the feed cam-selection groove formed on the back surface of the disk cam from the center of the cam, and the relation among the groove and stitch patterns, position of pattern-selection groove on the disk cam, zig zag pattern cams and feed cams.

The zig zag pattern cam-selection groove 20 has been so formed as shown by an expansion plan of FIG. 6 and is constructed as mentioned earlier. By turning the control dial 5, the pin 38 of operation plate lever 35 follows the zig zag pattern cam-selection groove 20 on the back surface of the disk cam; the distance to the center gradually reduces from point a to point n in the groove 20, whereby the operation plate 32 is lowered gradually causing the cam follower 61 to be lowered via positioning pin 41 studded on the operation plate 32. However, as the control dial 5 is turned further, the pin 38 is pushed up over the section from point n to point j', and lowered again over the section from point j' to point n'', causing the cam follower 61 to perform the same operation. For instance, therefore, referring to FIG. 6, the position of point k in the selection groove 20 is the same as the positions of point k' and point k''. Therefore, the end 61'' of the cam follower 61 is located at a position K in the zig zag pattern cams 52.

The operation of the mechanism for selecting the feed cams will now be described.

By turning the control dial 5, the pin 11 of the pointer needle operation lever 7 and the pin 38 of the operation plate lever 35 operate together, and the pin 83 of the slide block lever 81 engaged with the feed cam-selection groove 21 on the back surface of the disk cam 2 turns with the shouldered screw 80 as a fulcrum. The slide block lever 81 has a pin 82 which is engaged with the elongated hole 48' of the slide block adjustor plate 48 which is fastened to the slide block 46 by the feed positioning pin 47. The slide block 46 is further slidably mounted on the mounting plate 1 so as to slide in the elongated groove 45, and the end 47'' of the feed positioning pin 47 is engaged with the recess 71' of the feed cam follower 71. Therefore, the slide block lever 81 so works as to move the feed positioning pin 47 up and down by means of the slide block 46, whereby the feed cam follower 71 moves up and down on the feed cam follower shaft 70 so that the end 71'' of the feed cam follower 71 will select one of the laminate feed cams 53.

The feed cam-selection groove 20 is as shown in expansion plans of FIG. 5 and FIG. 6. If the disk cam 2 is so turned that the pin 83 of the slide block lever 81 is located at a position off ($off_1$ and $off_2$) ($off_1$ stays at an equal distance from the center and the pin 83 does not move, but the pin 83 is moved if the groove advances from $off_1$ to $off_2$), the end 71'' of the feed cam follower 71 is located at a position lower than the laminate feed cams 53 and does not work. However, if the disk cam 2 is further turned so that the pin 83 comes to a position X, the end 71'' of the feed cam follower 71 is located on a feed cam 53-X and will maintain its position. Then, if the pin 83 comes to a position y, the end 71'' of the feed cam follower 71 is located on a feed cam 53-Y.

The relationship between the pattern-selection groove 4 formed on the front surface of the disk cam 2, the zig zag pattern cam-selection groove 20 and the feed cam-selection groove 21 formed on the back surface of the disk cam 2 for obtaining desired composite stitch patterns will now be described.

Figure 7:
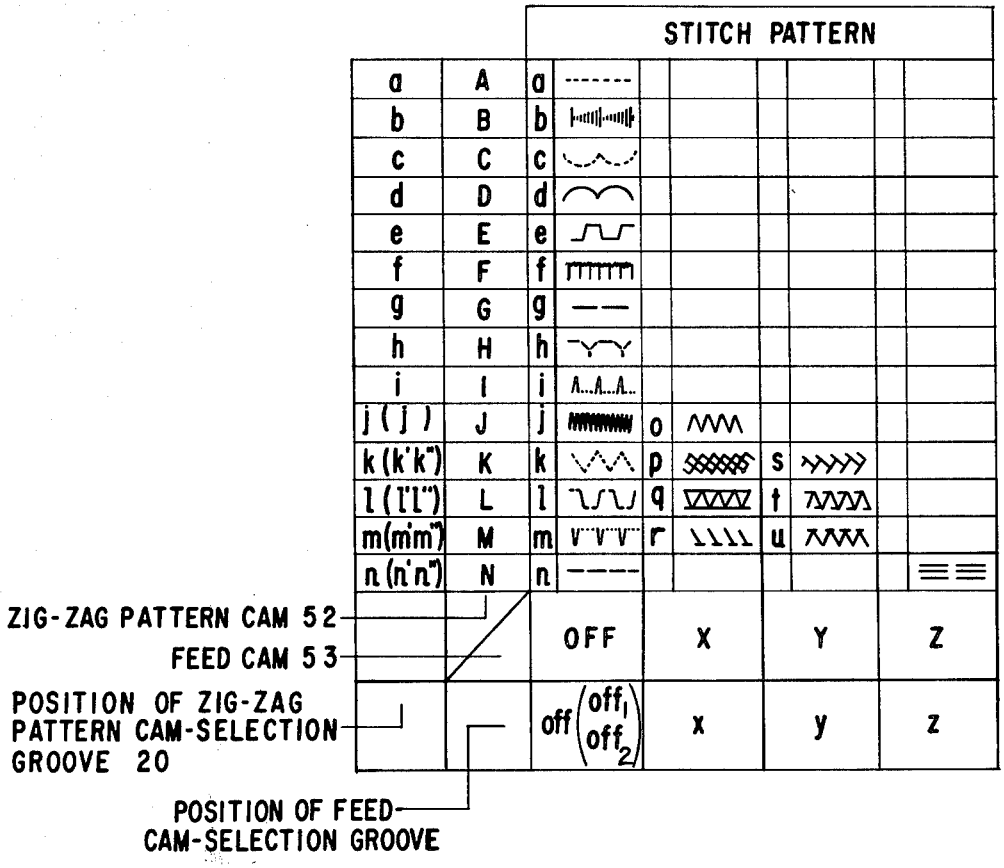
FIG. 7 is a diagram showing the relation between the positions in the zig zag pattern cam-selection groove and the zig zag pattern cams for obtaining various stitch patterns, and the relation between the positions in the feed selection cam groove and the feed cams, in the same manner as in FIG. 6.

For example, to obtain a stitch pattern a (see FIG. 7), a control dial 5 will be turned, so that the pin 11 of the pointer needle operation lever 7 is located at a position a of the pattern-section groove 4 and the position needle 14 indicates the stitch pattern a. At this time, the pin 38 of the operation lever 35 is located at a position "a" in the zig zag pattern cam-selection groove 20, and the end 61'' of the cam follower 61 is located on a zig zag pattern cam 52-A. In this case, the pin 83 of the slide block lever 81 is located at $off_1$ in the feed cam-selection groove 21, and the end 71'' of the feed cam follower 71 is located below (or out of engagement with) the laminate feed cam 53 and will not be influenced thereby. Therefore, only the cam follower 61 engages the zig zag pattern cams 52; a stitch pattern a is obtained without involving the function of the feed cams 53. The same operation as above will be performed to obtain stitch patterns b to m. To obtain a stitch pattern n, the pin 38 is shifted to a position "n" in the groove 20, the end 61'' of the cam follower 61 is located on a zig zag pattern cam 52-N, the pin 83 of the slide block lever 81 is moved a little to a position $off_2$ in the feed cam-selection groove 21, the feed cam follower 71 is moved accordingly, and the end 71'' thereof is raised a little. However, the end 71'' is still located at a position lower than the laminate feed cams 53, and does not engage therewith. Therefore, a stitch pattern n is obtained by the zig zag pattern cam 52-N only.

Further, to obtain a stitch pattern o, by turning the control dial 5, the zig zag pattern cam-selection groove 20 gradually separates away from the center. At the point m' in the groove 20, the distance is just equal to the previous point m. Therefore, the cam follower 61 that was once lowered is raised again, and located on the zig zag pattern cam 52-M. On the other hand, the feed cam groove 21 gradually approaches the center; as the pin 83 of the slide block lever 81 comes to a position x in the cam groove, the end 71'' of the feed cam follower 71 comes onto a feed cam 53-X. Therefore, the stitch pattern o is obtained by the composite functions of the zig zag pattern cam 52-M and the feed cam 53-X. In the same way, the stitch patterns p, q and r are obtained by the composite functions of the zig zag pattern cams 52-L, -J and -K, and the feed cam 53-X (in the embodiment, the point x in the feed cam-selection groove keeps the same position, and the feed cam follower 71 remains located on the same feed cam 53-X).

Then to obtain stitch patterns r, s and t, the control dial 5 is further turned. The zig zag pattern cam-selection groove 20 then gradually approaches the center, and the composite patterns are obtained by the points K'', 1'' and m'' in the groove 21 and the point y in the cam groove 20.

As mentioned above, by so forming the spiral zig zag pattern cam-selection groove that the distance is varied with respect to the center, it is possible to obtain, for example, three stitch patterns m, o and u by a cam 52-M among many zig zag pattern cams 52 and cams X and Y among many feed cams 53. According to the above-mentioned method, it is possible to obtain many more composite stitch patterns by varying not only the shape of the zig zag pattern cam-selection groove but also varying the shape of the feed cam-selection groove.

According to this invention, as mentioned above, the stitch patterns can be selected and indicated by means fo three grooves, i.e., pattern-indication groove, zig zag pattern-selection cam groove and feed selection cam groove that are formed on the disk cam, simply by turning the control dial. Besides, the device according to this invention is very simply constructed and handled as a single module (assembly), and is further manufactured cheaply, providing highly advantageous results.

Having thus set forth the nature of the invention, what is claimed herein is:

1. In a sewing machine having laminate pattern cams and laminate feed cams with which are engaged a zig zag cam follower and a feed cam follower, respectively, to obtain composite patterns, a device for selecting said laminate cams characterized in that a disk cam for pattern cam selection is so installed in a machine housing as to be turned by an operator influenced control dial on the exterior of the sewing machine, a stitch pattern indicator groove, a zig zag pattern cam-selection groove and a feed cam-selection groove are formed on the surfaces of said disk cam, individual followers are provided for tracking each of said grooves whereby one of the laminate pattern cams is selected by that cam follower which tracks said zig zag pattern cam-selection groove, one of the laminate feed cams is simultaneously selected by that cam follower which tracks said feed cam-selection groove, and a stitch pattern indicator is provided which is simultaneously set by that cam follower which tracks said stitch pattern indicator groove, wherein the stitch pattern-indicator groove is formed on the front surface of the disk cam, the zig zag pattern cam-selection groove and feed cam-selection groove are formed on the back surface of said disk cam, and said stitch pattern indicator comprises an operation lever having at its middle part said follower tracking said stitch pattern-indicator groove, said operation lever being pivoted to a mounting plate mounted on the machine housing, a pointer needle carrying member attached to the other end of said pointer needle operation lever via a link, and a pattern board inscribed with representations of stitch patterns attached to the mounting plate and arranged for cooperation with said pointer needle.

2. A device for selecting a laminate cam according to claim 2 wherein an operation plate is so mounted on the mounting plate as to slide in the upper and lower directions, said operation plate is engaged with one end of an operation plate lever which has at its middle part said follower that engages the zig zag pattern cam-selection groove on the back surface of the disk cam, and which is pivoted at the opposite end to said mounting plate, and in which a positioning pin which influences cooperation of the zig zag cam follower with a selected laminate pattern cam is secured on the operation plate.

3. A device for selecting a laminate cam according to claim 2, wherein a slide block is so mounted on the mounting plate as to slide in the upper and lower directions, a feed positioning pin which influences cooperation of the feed cam follower with a selected laminate feed cam is slidably attached to said slide block, and a slide block adjustor lever which is pivoted at one end to the machine housing, carries the follower that tracks the feed cam-selection groove on the back surface of the disk cam and is pivotally connected to the slide block.

* * * * *